US007255595B2

(12) United States Patent
Lo

(10) Patent No.: US 7,255,595 B2
(45) Date of Patent: Aug. 14, 2007

(54) ELECTRICAL CONNECTION DEVICE WITH A POSITION LIMITING BUTTON

(75) Inventor: Barry Lo, Hong Kong (CN)

(73) Assignee: AirConnect Solutions (Asia) Limited, Hong Kong (CN)

( * ) Notice: Subject to any disclaimer, the term of this patent is extended or adjusted under 35 U.S.C. 154(b) by 0 days.

(21) Appl. No.: 11/457,801

(22) Filed: Jul. 15, 2006

(65) Prior Publication Data

US 2007/0026727 A1 Feb. 1, 2007

(30) Foreign Application Priority Data

Jul. 18, 2005 (CN) ..... 2005 1 0085875

(51) Int. Cl.
*H01R 13/72* (2006.01)

(52) U.S. Cl. ..... 439/501; 439/4

(58) Field of Classification Search ..... 439/501, 439/4, 13; 242/378.1, 378.2
See application file for complete search history.

(56) References Cited

U.S. PATENT DOCUMENTS 3,409,246 A * 11/1968 De Pas ..... 242/378.2
5,339,461 A * 8/1994 Luplow ..... 455/351
6,378,797 B1 * 4/2002 Liao ..... 242/378.1
6,575,781 B2 * 6/2003 Wen-Hsuan et al. ..... 439/501
6,733,328 B2 * 5/2004 Lin et al. ..... 439/501
6,866,218 B2 * 3/2005 Liao ..... 242/378.1
7,001,210 B1 * 2/2006 Chiang ..... 439/501

* cited by examiner

*Primary Examiner*—Hae Moon Hyeon
(74) *Attorney, Agent, or Firm*—Global IP Services; Tianhua Gu

(57) ABSTRACT

The present invention provides an electrical connection device, which includes a position holding bar, a switching device sleeved outside of the position holding bar, and a wire twining device with position limiting button. The wire twining device comprises an active turnplate, an electrical connection wire enlaced on one surface of the turnplate, an activation point fixed on the other surface of the turnplate, and a reset spring fixed on the annular groove of the bottom of the turnplate; the outer end of the enlaced wire is electrically connected with an active wire port, the inner end of the enlaced wire is connected with the active touching point of the turnplate; a fixed touch point that corresponding to the active touching point is set on the connection device, so that the active touching point keeps the electrical connection with the fixed touching point of the connecting device while the electrical connection wire is twined with the turnplate. When implementing the electrical connection device, it is very convenience to control and use the wire, and makes the wire extending and retracting easily, thus reduces the mass caused by wires and saves the space.

6 Claims, 6 Drawing Sheets

ELECTRICAL CONNECTION DEVICE WITH A POSITION LIMITING BUTTON

CROSS REFERENCE TO THE RELATED PATENT APPLICATION

This application claims the priority right of the Chinese patent application No. 200510085875.7 filed on Jul. 18, 2005.

BACKGROUND OF THE INVENTION

1. Field of the Invention

This invention relates to an electrical connection device, more particularly, relates to an electrical connection device with flexible wire.

2. Description of Prior Art

The electrical equipments in the prior art, such as TVs, refrigerators, washing machines, rice cookers, etc., are require wires to connect to peripheral devices or power source. Although there already has a few wireless connection devices, it is not broadly employed due to the high cost. As the length of wires in the prior art is unchangeable and can not be packed away, especially when they not in use, in this regard, plurality of wires is exposed in the working environment of the equipments, this will affects the appearance of the equipments as well as the working efficiency. Particularly with the situation of broad popularization of computers, more and more wires are needed, such as power supply wires, keyboard wires, mouse wires, printer wires, LAN wires etc, further more, various communication devices, such as mobile phones, digital devices (e.g., wires, data cables and charger wires of digital cameras etc.); with all these wires around the working platform, it will be very inconvenient if the wires be twisted. In fact, some of the wires are temporally unused but there's no place to store them; some of the wires are longer than they are required, but can not be shorted; moreover, some of the wires are shorter than it is required, but they are not extendable.

SUMMARY OF THE INVENTION

The object of the current invention is, to provide an electrical connection device with flexible wire, to solve the problems of the connection and storage of the wire.

The technical feature of the current invention for solving the problems is: provides an electrical connection device, which includes a position holding bar, a switching device sleeves outside of the position holding bar, and a wire twining device with position limiting button. The wire twining device comprises an active turnplate, an electrical connection wire enlaced on top surface of the turnplate, an active touching point fixed on the lower surface of the turnplate, and a reset spring fixed in a round ridge of the lower surface of the turnplate; the outer end of the enlaced wire is electrically connected with an active wire exit port, the inner end of the enlaced wire is connected with the active touching point of the turnplate; a fixed touching point that corresponding to the active touching point is set on the connection device, so that the active touching point keeps the electrical connection with the fixed touching point of the connecting device while the electrical connection wire is twined with the turnplate.

Advantageously, the fixed touching point is two or more concentric circle electric tracks that fixed on the switching device.

Advantageously, the active touching point is a lug boss made of bended tip of the inner end of the enlaced wire, the lug boss reveals outside of the ridge of the bottom of the turnplate, and electrically connected with the fixed touching point of the circle electric tracks of the switching device.

Advantageously, the turnplate is a 3-level-structure turnplate, where a disk with larger diameter is set in the middle level, and its centre is corresponds to the position holding bar; a hollow bar on the upper side of the turnplate extends upward for enlacing wire, and a pair of baffles is deposited inside the hollow bar, the bottom surface of the baffle is formed a first incline surface, and there's a thickness difference between two ends of the baffle of the first incline surface. A round ridge on the lower side of the turnplate is extends downwards, and a reset spring is deposited inside the ridge, two pairs of symmetrically distributed partial annular ridges are set on the outside of the round ridge, and there is a hole is cut on one end of each partial annular ridges, The inner side of the wire is pulled through the hole to wedge inside the partial annular ridges.

Advantageously, the active touching point can be electric track that wedged inside two or more annular ridges that on the underside of the turnplate. The fixed touching point is at least two metal protrudes fixed on the switching device, and electrically connected with the electric track.

Advantageously, the turnplate may also be a 3-level-structure turnplate. Where a disk with larger diameter is set in the middle level, the centre of the turnplate is a hole that corresponds to the position holding bar on the lower shell body, a hollow bar on the upper side of the turnplate that for enlacing wire is extends upwards, and a pair of baffles is deposited inside the hollow bar, the bottom surface of the baffle is formed a first incline, and there's a thickness difference between two ends of the first incline surface. A round ridge on the lower side of the turnplate is extends downwards, and a reset spring is deposited inside the ridge, symmetrically distributed partial annular ridges are fixed on the outside of the round ridge. A hole is cut on each of the annular ridges. The inner side of the wire is pulled through the hole and circle wise wedged inside the annular ridges.

Advantageously, the position limiting button comprises a non circular bar with its upper end inserted inside the button hole of the upper shell body, the shape of the non circular bar is corresponds with the shape of the hole, a bar with larger bottom diameter and a pair of position limiting pieces fixed on it; The upper surface of the position limiting piece is formed a second incline surface, which matches with the first incline surface of the baffle; and a spring hole is fixed on the bottom of the position limiting bottom, which support the position holding bar of the bottom shell body by a spring.

Advantageously, the inner end of the reset spring is bended to form a first hook and wedged on the position holding bar of the bottom shell body; and the outer end is bended to form a second hook and wedged on the round ridge of the turnplate.

Advantageously, the electrical connection device further comprises a shell body for fixing the switching device and the position holding bar, the shell body comprises a hole that separate the outer end of the wire from the active wire exit port.

Advantageously, the switching device comprises a printed circuit board (PCB) and a circuit unit that connected with the wire enter port, the element of the circuit unit is installed on the (PCB).

The benefits of implementing this invention are: in accordance with this invention, the wire can be stored inside the shell body, and installed on or inside the electrical equipments. The power supply ports of electrical equipments are connected to wire entrance. When in use, only needs to pull out a required length of wire, and when not in use, only needs to press the position limiting button to retract the wire back to the shell body. In this case, the wires are controlled conveniently. By implementing the flexible wires, the mass of wires are reduced, as well as saving spaces.

DETAILED DESCRIPTION OF THE INVENTION

The present invention will be described in accordance with the drawings and the following embodiments.

Figure 1:
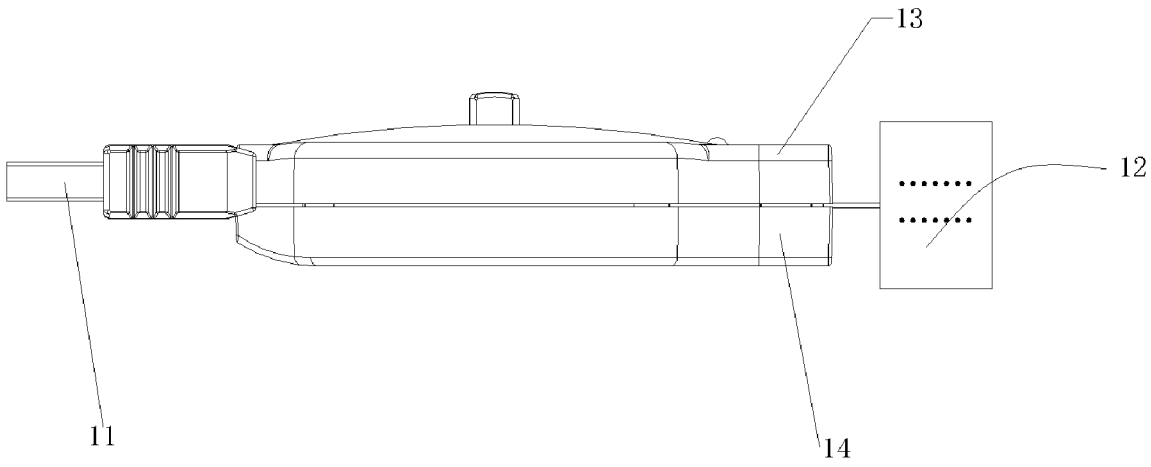
FIG. 1 is the front view of the electrical connection device of the present invention.
Figure 2:
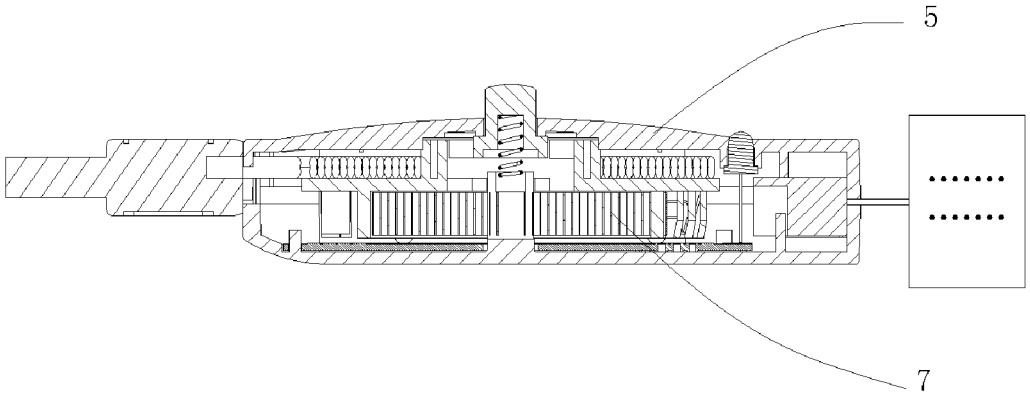
FIG. 2 is the section view of the electrical connection device of FIG. 1.

As shown in FIG. 1 and FIG. 2, according to one embodiment of the present invention, the main structure of the electrical connection device comprising a top shell body 13, a bottom shell body 14, elements contained in the inner space that formed by the top and bottom shell bodies, and a wire exit port 11 and a wire enter port 12 that extend outside of both sides of the shells. A tenon is set on the periphery of the top shell body 13, and a hook is set on the tenon. Correspondingly, the periphery of bottom shell body 14 is fixed with an upward extending mortise having a slot that is engaged with the hook of the top shell body. The top shell body 13 and bottom shell body 14 forms an outer shell of the electrical connection device by the engagement of the tenon and mortise.

Figure 3:
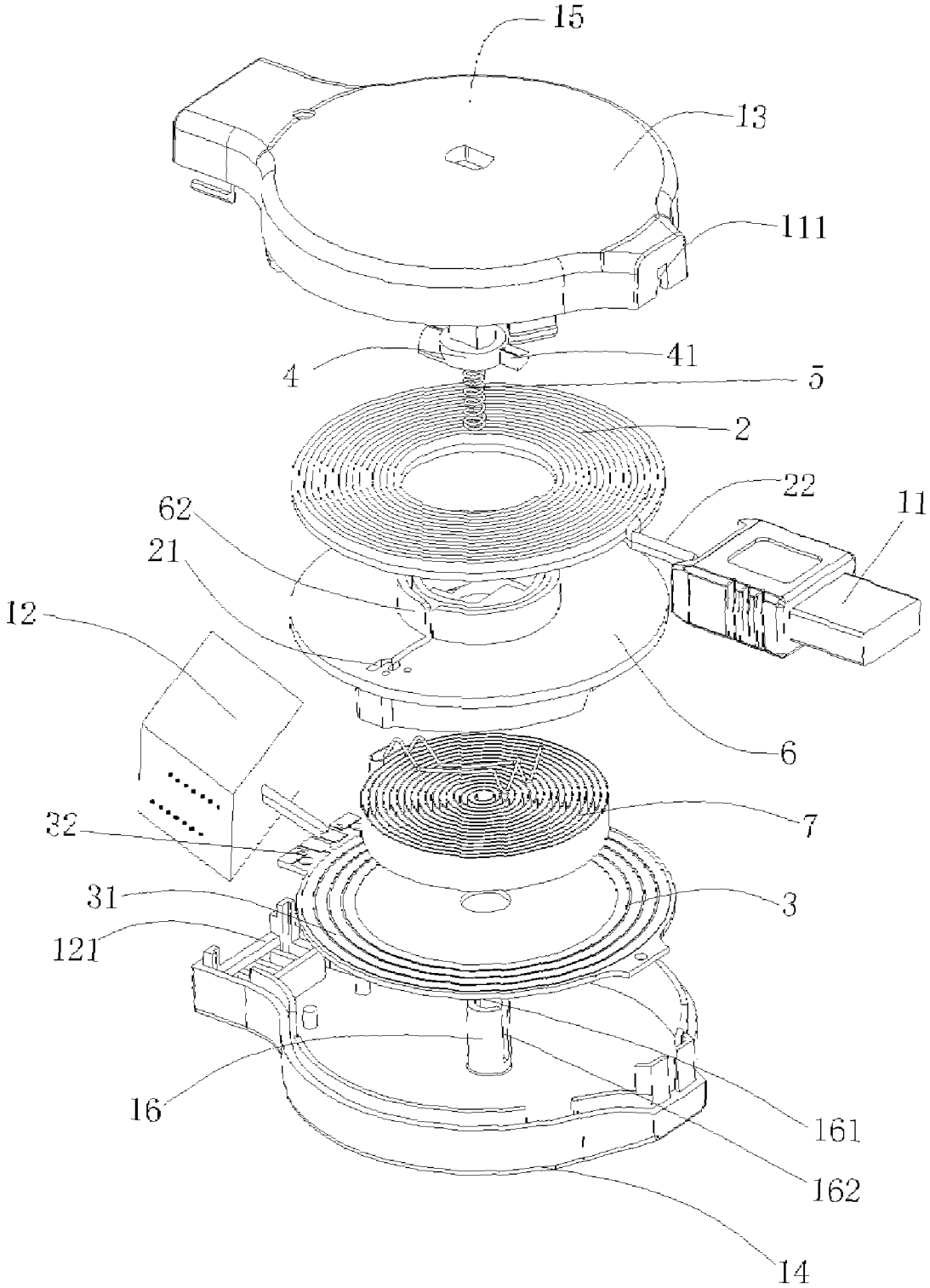
FIG. 3 is the exploded view of the electrical connection device from top to bottom, in accordance with an embodiment of the present invention.
Figure 4:
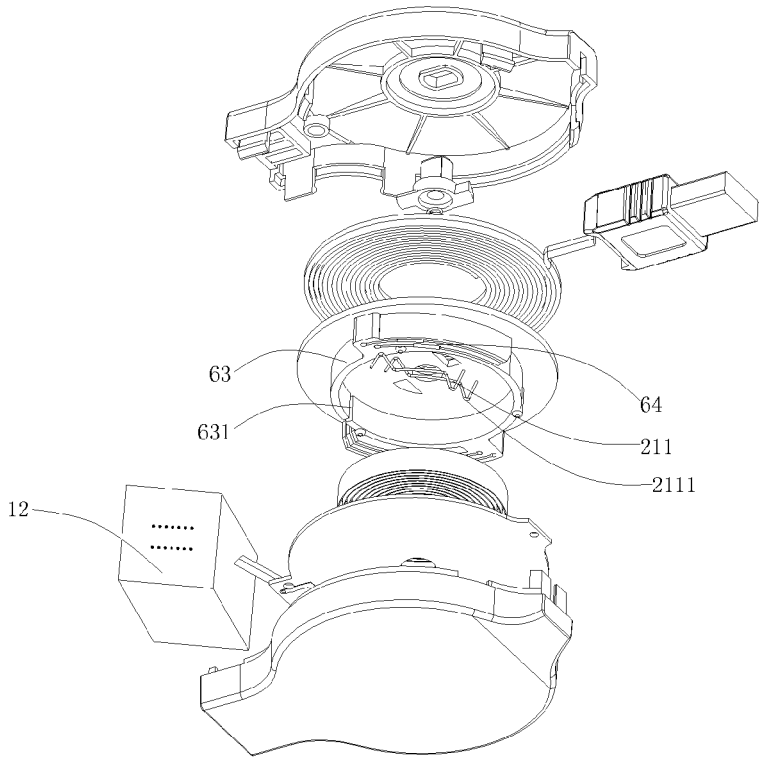
FIG. 4 is the exploded view of the electrical connection device from bottom to top, in accordance with an embodiment the present invention.

FIGS. 3 and 4 are exploded views of the electrical connection device from top to bottom and from bottom to top, in accordance with an embodiment the present invention. As shown, there are notches set on both sides of top shell body 13 and bottom shell body 14 respectively, when the top and bottom shell body closed together, it forms a relevant wire entrance 121 and wire exit 111. An enlacing outer end 22 of the wire 2 is pulled out from the wire exit 111 and electrically connected with the wire exit port 11. An enlacing inner end 21 of the wire is electrically connected to wire enter port 12 via switching device 3.

A position limiting button hole 15 is set on the top surface of the top shell body 13, and a position holding bar 16 which extends upwards is fixed on the bottom surface of the bottom shell body 14. The position limiting button hole 15 is formed by the left and right cylindrical surfaces and the front and back surfaces. A position holding hole 161 is set on position holding bar 16 along the axis orientation, and two notches 162 are cut symmetrically on the side wall of the position holding bar 16.

Figure 5:
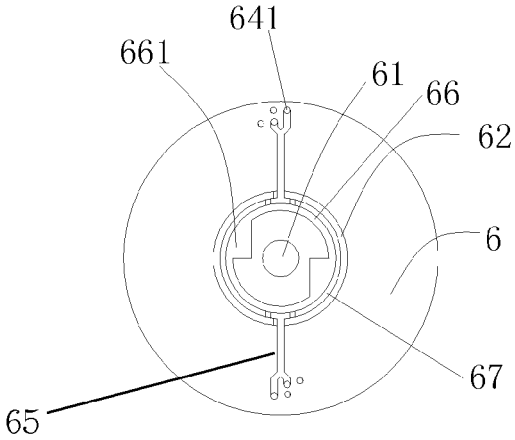
FIG. 5 is the top view of the turnplate of the electrical connection device, in accordance with an embodiment the present invention.
Figure 6:
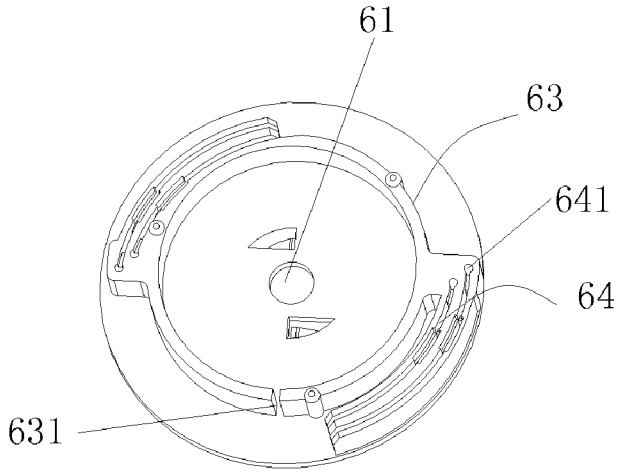
FIG. 6 is three-dimensional view of the turnplate of the electrical connection device, in accordance with an embodiment the present invention.

Elements contained in the inner space that formed by the top and bottom shell bodies comprises a switching device and a wire enlacing device with position limiting button that sleeve on the position holding bar 16 in sequence. The wire enlacing device includes a position limiting button 4, a turnplate 6, a wire 2 enlaced on the top surface of the turnplate 6, a reset spring 7 located on the lower surface of the turnplate 6. As shown in FIG. 5 and FIG. 6, the turnplate 6 is a 3-level-structure turnplate, a disk with larger diameter and exact size to fit into the inner space of the shell body is in the middle, while a hole 61 is cutting in the centre of the disk and the disk is sleeved onto the position holding bar 16 through this hole. A hollow bar 62 extends upwards from the top surface of the turnplate and a certain length of wire 2 enlaces on the hollow bar 62. A concentric hollow bar 66 with a smaller diameter is disposed on the inner side of the hollow bar 62, an annular slot 67 is formed between the hollow bar 62 and 66, as shown in FIG. 5. A pair of baffles 661 is symmetrically fixed on the top portion of the inside wall of the hollow bar 66, the top surface of the baffle 661 is on the same level with both hollow bars; and the bottom surface of the baffle is the first incline surface, there is thickness difference between two ends of the first incline face, and there also has a certain space between the bottom surface of the baffle 661 and the top surface of the turnplate. In addition, two notches are symmetrically cut on the side wall of the hollow bar 62, and a narrow slot 65 is cut on the top disk surface and from inside to outside, multiple holes 641 at the end of the narrow slot 65 are set to drill through the disk. When enlacing the wire 2, put the enlacing inner end of the wire 2 into the annular slot 67, then pull out the wires through the two notches of the hollow bar 62 to separate the wires into two parts according to the types of the wires, and then insert the wires into the narrow slot 65, meanwhile, pulling each part of the wires from holes 641 to the other side of disk. Therefore, the amount of holes 641 is depends on the amount of parts that formed wire 2.

Figure 7:
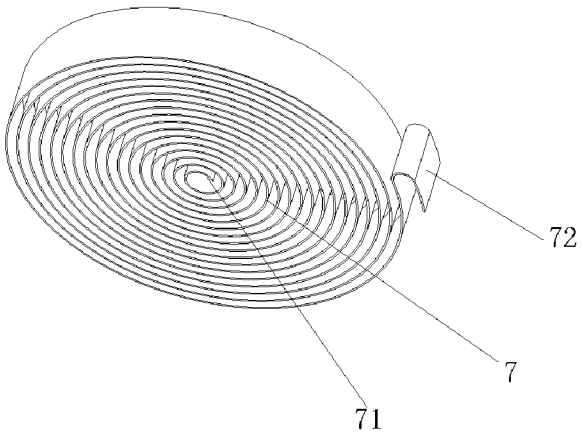
FIG. 7 is three-dimensional view of the reset spring of the electrical connection device, in accordance with an embodiment the present invention.

As shown in FIG. 6, a round ridge 63 is downwards extends from the bottom side of the active disk 6, a notch 631 is cut on the side wall of the round ridge 63, and the reset spring 7 is deposited inside the ridge 63. The reset spring 7 is made of an enlacing metal slice that has been entwined several circles. As FIG. 7 showing, the inner metal slice of the reset spring 7 is bended to form a first hook 71 and the outer metal slice is bended to form a second hook 72. When in using, the first hook 71 buckles in the notch 162 of the position holding bar 16, and the second hook 72 buckles in the notch 631 of the round ridge 63. In this case, reset spring 7 can be frapped along with the turning of the turnplate 6 around the position holding bar 16 to create elastic deformation that has reset trend, therefore, leads the turning of the turnplate 6 when resetting. As shown in FIG. 6, partial annular ridges 64 are symmetrically distributed on the outer side of the ridge 63, the number of the partial annular ridges 64 are in accordance with the number of forming parts of wire 2; and one end of the partial annular ridges 64 is exactly begins from the hole 641. The wire 2 is drawn from top to bottom of the disk through hole 641 and its each part of inner ends 21 is deposits into the partial annular ridges 64 separately, And a metal tie-in 211 is soldered on the end of each part of the enlacing inner ends 21. The tie-in 211 of wire 2 can be a cooper wire, or other conductive metal wire with high rigidity. Both ends of each tie-in 211 are bended to form a "V" shaped lug boss 2111 and expose to outside of the partial annular ridges 64 to form the active touching point of the electrical connection device.

As shown in FIG. 3, the switching device 3 of the electrical connection device of the present invention sleeves on the position holding bar 16 located inside the bottom shell body 14 through the centre hole, and is further fixed inside the bottom shell body 14 through the present mode of position holding hole. The wire enlacing device is above the switching device 3. The switching device 3 comprises a PCB and a circuit unit 32 installed onto the PCB. The circuit unit 32 is connected with the wire enter port 12, with LED light to indicate the working status of the electrical connection device. The Switching device 3 further includes two or more concentric circle electric tracks 31 which are centered at the position holding bar. The electric tracks 31 are working as fixed touching point, and correspond to the lug boss 2111 of the enlaced wire inner end 21, and it further forms an electrical connection by tightly contacting with the lug boss 2111. The electric tracks 31 could be a printed circuit set on the switching device 3, which has electrical connection with circuit unit 32. In this regard, when turnplate 6 is turning, lug boss 2111 may rotate along with the electric tracks 31 while keeping tight electrical connecting between them. Therefore, implement the electrical connection between the inner end of the enlaced wire 2 and wire enter port 12 via switching device 3.

Figure 8:
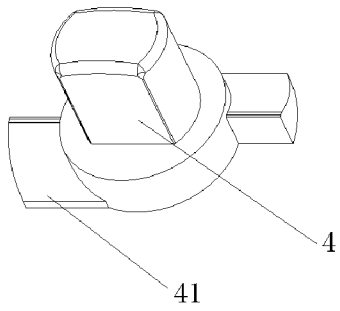
FIG. 8 is three-dimensional view of the position limiting device of the electrical connection device, in accordance with an embodiment the present invention.

The upper end of the position limiting button 4 of the wire enlacing device is inserted into the position limiting hole 15 of the top shell body 13, the lower end supports with the position holding hole 161 of the position holding bar 16 by spring 5. As shown in FIG. 8, position limiting button 4 is a non-cylinder that its top shape corresponds with the position limiting button hole 16, a cylinder with larger bottom diameter, and a pair of position limiting piece 41 on the wall of the cylinder. The bottom of the position limiting piece 41 is on the same level with the bottom of the cylinder. The top surface of the position limiting piece 41 is the second incline surface, which matches with the first incline surface of the baffle 611 on the turnplate 6, has a certain thickness difference on both ends along the direction of the second incline surface. Also a spring hole is fixed on the bottom of the position limiting button 4, and one end of the spring is deposited into the spring hole, the other end is inserted into the position holding hole 161 of the position holding bar 16.

Figure 10:
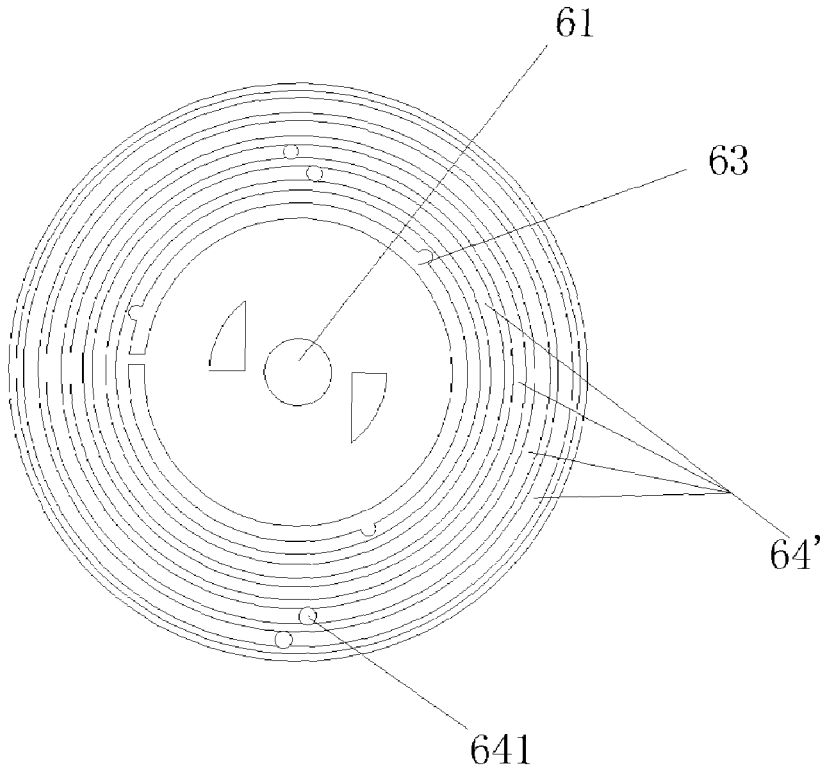
FIG. 10 is the bottom view of the turnplate of the electrical connection device, in accordance with another embodiment of the present invention.

According to another embodiment of the present invention, as shown in FIG. 10, round ridge 63 is extends from the lower surface of the turnplate 6, notch 631 is cut on the wall of the ridge 63, and resetting spring 7 is contained inside the ridge 63 and wedged in the notch 631 by the second hook 72. Two or more concentric annular ridges 64' is distributed outside the round ridge 63, the number of the ridges 64' are accordance with the forming elements of the wire 2, and hole 641 is exactly positioned into the round ridges 64'. Each part of the metal wire of the inner end 21 of enlaced wire pulled from upper disk to lower disk via holes 641 are contained in the annular ridges 64' respectively, to form the annular electric track. Or, the metal tie-ins soldered on each end of the enlaced wire 21, then clip inside ridge 64' to form annular electric tracks. The tie-ins can be a certain length of copper wire, or other conductive metal wire with high rigidity. In this regard, the annular electric tracks form the active touching point of the electrical connection device.

Figure 11:
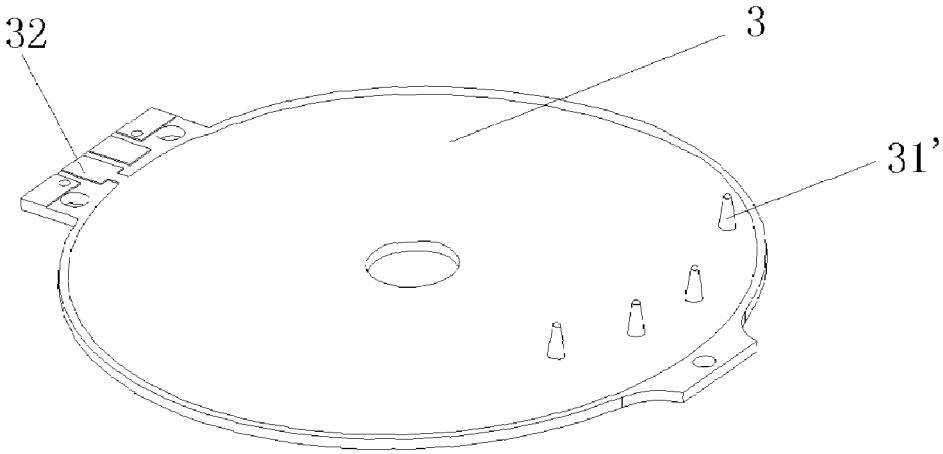
FIG. 11 is the bottom view of the switching device of the electrical connection device, in accordance with another embodiment of the present invention.

Correspondingly, as shown in FIG. 11, switching device 3 on the bottom of the active disk 6 sleeved on the position holding bar 16, and fixed on the bottom shell body 14 via the mode of position holding hole. Two or more metal protrudes 31' are fixed on the switching device 3, their positions are corresponding with each annular ridge 64' of the active disk 6. The top of the metal 31' extends into annular ridge 64', and formed as fixing touching point tightly and electrically touching with the electric track 2111' of the annular ridge 64'. Another end of the metal 31' is connected to the circuit unit 32. Thus the switching device 3 can be a piece of POB with metal protrude 31' jointed thereon. In this regard, when active disk 6 is turning, electric track 2111' rotating also, and the metal protrude 31' keeps tight electrical connection between the electric track 2111' and the active disk 6 while sliding relatively. Therefore, implement the electrical connection between the enlacing inner end of wire 2 and wire entrance 12 via switching device 3.

The principle of how the wire can be extended and rolled by the electrical connection device will describe as following.

Figure 9:
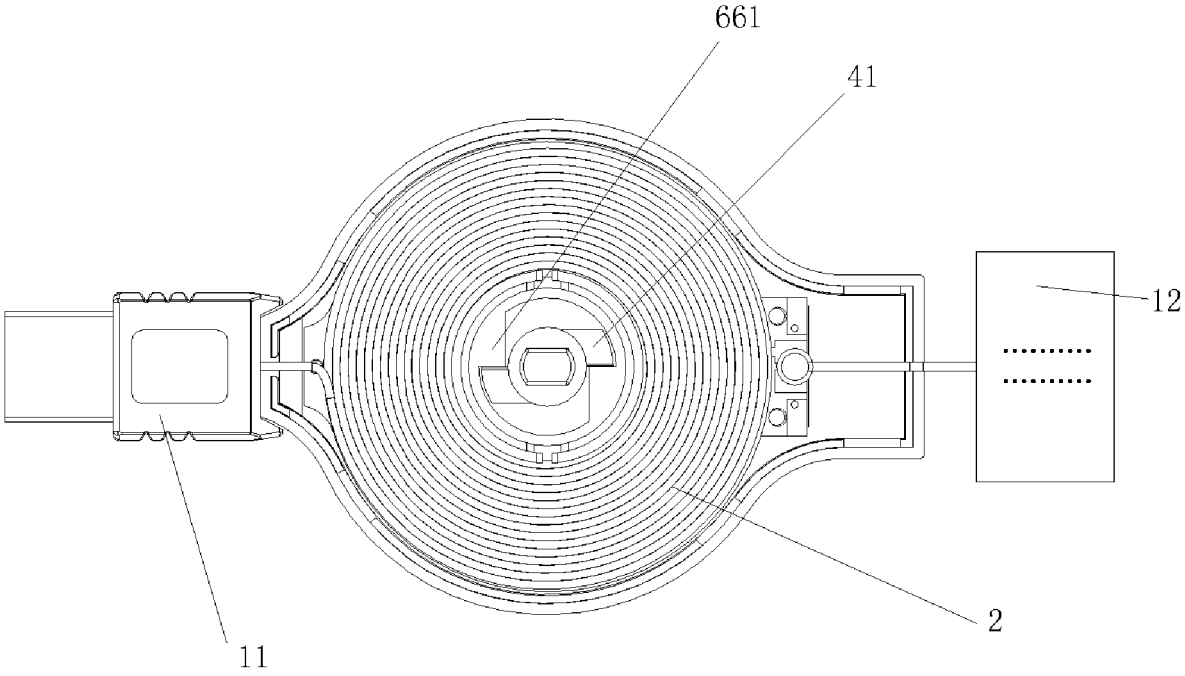
FIG. 9 is the top view of the electrical connection device without top shell body, in accordance with an embodiment the present invention.

When the electrical connection device is not in use, as shown in FIG. 9, wire 2 is deasil enlaced inside the electrical connection device, the exiting end of the active wire is situated at the wire exit port 11; Position limiting button 4 is extended outside the top shell body 13, spring 5 and resetting spring 7 is in original status. The thicker end of the position limiting piece 41 and the thicker end of the baffle 661 supported to each other, and the thinner end of the position limiting piece 41 and the thinner end of the baffle 661 is in the status of back to back. The turnplate 6 can not turn anti-clockwise due to the upper end of the position limiting button is limited by the position limiting hole 15, and it is further prevents the turnplate 6 from turning clockwise due to the elastic deformation effect of the resetting spring 7.

If longer wire is needed while in use, the user may pull the wire exit port 11 to pull the wire 2 out of the wire exit 111. In this regard, due to the pulling of wire 2, active disk 6 may overcome the elasticity of resetting spring 7 to turn clockwise, forcing the baffle 661 disengage from the position limitation caused by the position limiting piece 41. And, the baffle 661 pushes the position limiting piece 41 to the space under the baffle 661 by the force from the first incline surface to the second incline surface, to let the baffle 661 pass over the position limiting piece 41 smoothly, and the spring 5 is in compression status also. Active disk 6 rotates clockwise along with the pulling of wire 2, while frapping the resetting spring 7 clockwise, and producing elastic deformation with resetting trend. During the pulling of wire, the active touching point on the active disk 6 remains tight contact with the fixed touching point on the switching device 3.

After pulled out to required length, wire 2 is released, and the turnplate 6 rotates anti-clockwise due to the force of resetting spring 7. In this regard, spring 5 ejects the position limiting button 4, and the position limiting piece 41 returns to original status; the thicker end supports on the thicker end of baffle 661, which forcing the active disk 6 can not rotate anti-clockwise, thus, keeping the wire 2 with required length.

When need to pull out the wire, the user can also press and hold the position limiting button 4 to compress the spring 5, the position limiting piece 41 is located in the space that under the baffle 661 and can pass through the space smoothly, therefore the turnplate 6 can rotate clockwise along with the wire extending direction. In this regard, resetting spring 7 is frapped along with the rotation of turnplate 6 to produce elastic deformation with reset trend. During the pulling of the wire, the active touching point of turnplate 6 remains tight contact with the fixed touching point of switching device 3. While wire 2 is pulled out for required length, releasing wire 2 and position limiting button 4, and spring 5 will eject button 4; the position limiting piece 41 of the position limiting button 4 contacts and collaborates with the baffle 661 of the active disk 6, thus keeps the active disk 6 can not rotate, and remains the required length of wire 2.

When the out pulled wire need be retracted, the user only need to press position limiting button 4, turnplate 6 will rotate anti-clockwise under the effect of the resetting spring, to enlace the wire 2 back to the active disk 6 and return to original status. Since one end of the resetting spring 7 is wedges on the notch 162 of the bar 16, the resetting spring 7 fraps along with the rotation of active disk 6, producing elastic deformation with resetting trend; While pressing down the position limiting button 4, baffle 661 disengaged with the position limiting piece 41, and turnplate 6 rotates anti-clockwise due to the resetting effect of the resetting spring 7, the wire 2 enlaced back to active disk 6 and stored inside the shell body thus to reduce the mass caused by wires.

The electrical connection device of the present invention may be implemented on or inside the electrical equipments. The wire enter port 12 can be connected with the electrical equipments by insertion, soldering, screwing, rivet joint, etc., and the wire enter port can be fixed into or onto the shell body of the electrical equipment for convenient retraction and exceeding.

What is claimed is:

1. An electrical connection device, comprising:

a shell body including a top shell body and a bottom shell body;

a position holding bar located in a center of the bottom shell body;

a switching device sleeved outside of the position holding bar having two or more concentric circle electric tracks fixed on it to form a fixed touching point;

a wire twining device, having a turnplate, a hollow bar on a top surface of the turnplate extending upward, a pair of baffles with a first incline surface are deposited inside the hollow bar, a round ridge is on a lower surface of the turnplate extending downward, two pairs of partial annular ridge are distributed outside the round ridge concentrically, there is a hole at one end of each partial annular ridge, a wire is enlaced on the top surface of the turnplate, an inner end of the wire is pulled through the hole into the partial annular to connect with a tie-in, two ends of the tie-in are bend to form a V shaped lug boss that exposes to outside of the partial annular ridge to form an active touching point, the fixed touching point is corresponding to the active touching point, both keep a moveable electrical connection, a reset spring is fixed in the round ridge, its out end is connected with the round ridge and its inner end is connected with the position holding bar;

a position limiting button, having a non-cylinder bar and a pair of position limiting pieces, the upper shell body has a non-cylinder button hole that is corresponding to the shape of the non-cylinder bar, which is inserted into the button hole, a upper surface of the position limiting piece is formed a second incline surface that matched with the first incline surface of the baffle, a spring hole is fixed on the bottom of the position limiting button, a spring is located in the spring hole to support the position holding bar;

a wire enter port connected with the fixed touching point and a wire exit port connected with a outer end of the wire.

2. The device according to claim 1, wherein the turnplate is a 3-level-structure turnplate, a disk with larger diameter is set in the middle level, and a center hole corresponds to the position holding bar, there's a thickness difference between two ends of the first incline surface.

3. The device according to claim 1, wherein the two pairs of partial annular ridge are changed as two or more concentrical annular ridges, electric tracks are wedged into them to become the active touching point, the two or more concentric circle electric tracks become at least two metal protrudes fixed on the switching device become the fixed touching point, the active touching point moveable connects with the fixed touching point.

4. The device according to claim 1, wherein an inner end of the reset spring is bended to form a first hook and wedged on the position holding bar of the bottom shell body; and an outer end is bended to form a second hook and wedged on the round ridge of the turnplate.

5. The device according to claim 1, wherein the shell body comprises a hole that separates the outer end of the wire from the wire exit port.

6. The device according to claim 5, wherein the switching device further comprises a printed circuit board (PCB) having a circuit unit and a LED, the printed circuit board (PCB) connects with the wire enter port for indicating working status of the electrical connection device.

* * * * *